United States Patent [19]

Mingus et al.

[11] 3,942,670

[45] Mar. 9, 1976

[54] PALLET-LESS DRUMS

[76] Inventors: John Mingus; Mary Mingus, both of 3349 Sandy Beach Road, Grand Island, N.Y. 14072

[22] Filed: Jan. 31, 1975

[21] Appl. No.: 545,786

[52] U.S. Cl. ..... 220/23.4; 108/51; 206/386; 214/10.5 R; 220/1.5

[51] Int. Cl.[2] ..... B65D 19/08

[58] Field of Search..... 214/620, 10.5 R, DIG. 4; 108/52, 51; 206/386; 220/1.5, 23.4

[56] References Cited

UNITED STATES PATENTS

| | | | |
|---|---|---|---|
| 3,031,207 | 4/1962 | Bard | 220/23.4 X |
| 3,164,252 | 1/1965 | Hosbein | 206/386 |
| 3,521,777 | 7/1970 | Vik | 206/386 X |
| 3,602,368 | 8/1971 | Gould | 206/386 |
| 3,844,427 | 10/1974 | Miles-Luscombe et al. | 214/10.5 R X |

*Primary Examiner*—Frank E. Werner

[57] ABSTRACT

A drum shaped container equipped with a tapered base plate having an inverted U-shaped channel extending diametrically through the bottom surface thereof, and a retrainer strap provided with adjustment holes in one end thereof and having a retainer spring resiliently connecting the ends of the strap together, the strap adapted to be passed about four of the drums with the channels in the base plate of the front pair of drums being longitudinally aligned with the channels in the back pair of drums so that the channels may be engaged by the lifting forks of a fork-lift truck for simultaneous movement of the four individual drum containers.

1 Claim, 6 Drawing Figures

PALLET-LESS DRUMS

BACKGROUND OF THE INVENTION

1. Field of the Invention

This invention relates generally to containers and more particularly to individual drum shaped containers and a retainer strap for the holding of at least four of such containers for simultaneous transport thereof.

2. Description of the Prior Art

In the field of industrial equipment and supplies, it is common practice for moving large loads, such as drum shaped containers, by placing such containers on a pallet with such pallet provided with access openings for the lifting fork of a forklift truck so that by insertion of the forks into the pallet openings the pallet and the load thereon may be transported to a desired location. The use of such pallet requires several operations as to the placing of the drums on the pallet, the securement of the drums to each other or to the pallet to prevent them from falling off of the pallet, the requirement of having pallets readily accessible for use, and the additional operation of constantly transporting pallets between locations of use.

SUMMARY OF THE INVENTION

The present invention recognizes the disadvantages of utilizing pallets for transportation of drum shaped containers, and provides a novel solution thereto in the form of a set of at least four individual drum shaped containers, each provided with a tapered base plate with a channel extending therethrough and with a strap provided to hold the drums together in side-by-side relationship to provide a front pair and a back pair of drums with the channels in the front pair aligned with the channels in the back pair for receiving the forks of a forklift truck therethrough for ease of lifting and transportation of the set of drums in a pallet-less manner so that no pallet is required.

Additional features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
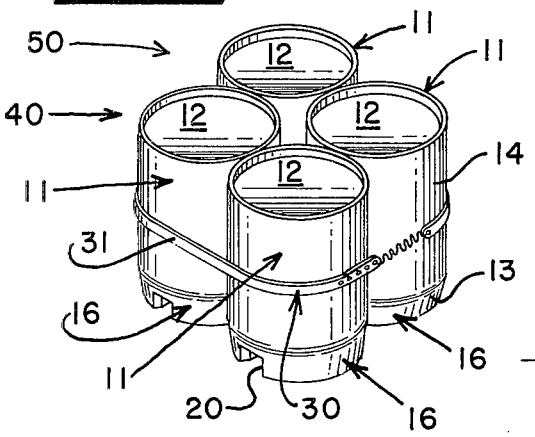
FIG. 1 is a perspective view of the set of four individual drum containers of the invention secured together by the retainer strap of the invention.
Figure 2:
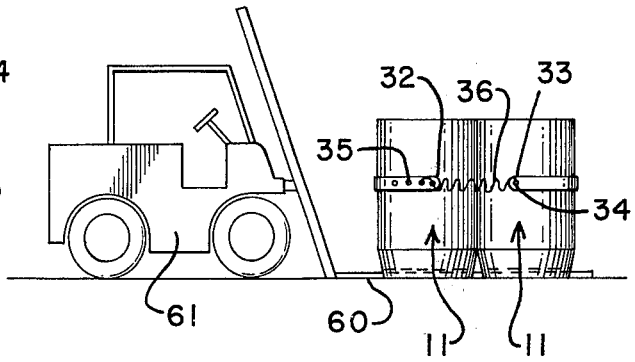
FIG. 2 is a side elevational view of the set of containers resting on the ground illustrating the forks of a forklift truck extending through the base plate channels.

Referring now to the drawings in detail, there is illustrated individual drum shaped containers 11 each being of a general fifty-five gallon size having a flat top surface 12, a flat bottom surface 13, and cylindrical side walls 14.

Affixed to the bottom 13 of each drum 11 is an inverted frusto-conical shaped base plate 16 having a flat top surface 17, a flat bottom surface 18, conical side walls 19, and an inverted U-shaped channel 20 extending diametrically therethrough and opening out of the bottom surface 18.

An elongated flat flexible retainer strap 30 is provided and includes body member 31 having opposite ends 32 and 33 with end 33 provided with a single opening 34 extending therethrough and with end 32 having a series of openings 35 spaced longitudinally apart from each other providing adjustment openings. A resilient retainer spring 36 is provided having its opposite ends adapted to be engaged at one end in opening 34 and at the opposite end in selected ones of openings 35.

In operation, a drum containers 11 are placed in parallel side-by-side relationship to define a front pair of drums 40 and a back pair of drums 50 with the channels 20 of the set of drums 40 extending parallel to each other and being longitudinally aligned with the set of channels 20 associated with the set of drums 50. Retaining strap 30 is passed about the general midpoints of the cylindrical sidewalls 14 of drums 11 with retaining spring 36 extending between openings 34 and 35 to snugly retain the retaining strap in position to retain the drums in their relative positions.

Figure 3:
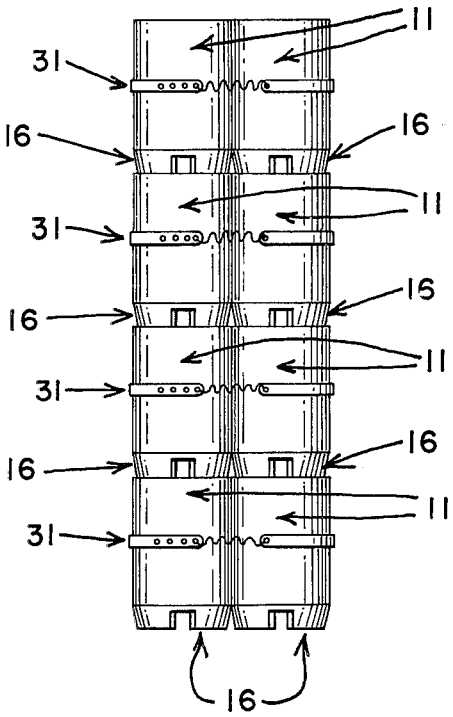
FIG. 3 is a side elevational view of the sets of containers stacked on top of each other for storage purposes.
Figure 4:
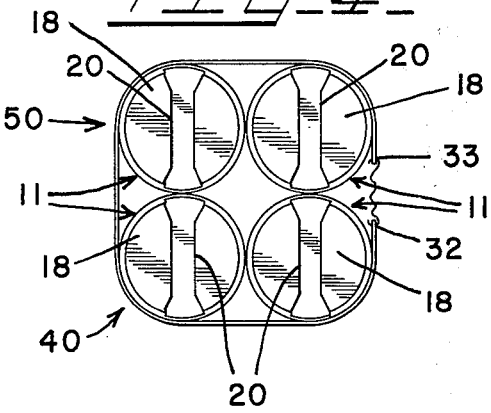
FIG. 4 is a bottom plan view of the set of containers of FIG. 1.

The lifting forks 60 of forklift truck 61 may then be readily inserted through aligned channels 20 for the lifting and movement of the drums in a pallet-less manner to any desired position, such as to the stacked position as generally illustrated in FIG. 3.

As noted in FIG. 3, the sets of drums may be readily stacked on top of each other in view of the tapered base plate 16 permitting base plate bottom surface 18 to be fully received within the perimeter of cylindrical side walls 14 to rest on drum top surface 12.

Figure 5:
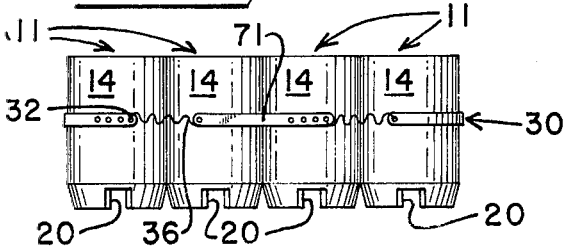
FIG. 5 is a side elevational view of an alternative means of fixing the four containers together by the retainer strap.
Figure 6:
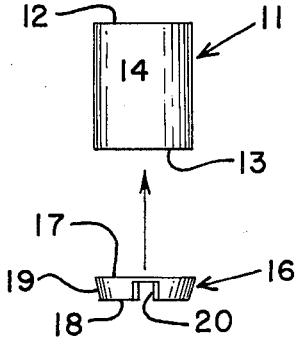
FIG. 6 is an exploded side elevational view of the base plate as affixed to the bottom of the drum container.

As seen in FIG. 5, it is envisioned that the drums 11 may be stacked in a series of four individual drums in side-by-side parallel relationships such that all of the channels 20 are in parallel alignment with each other, the drums being held in this manner by retainer strap 30 provided with an extension strap member 71 secured between the opposite ends 32 and 33 of the retainer strap by a pair of retainer springs 36.

It is to be understood that the form of this invention herewith shown and described is to be taken as a preferred example of the same, and that this invention is not to be limited to the exact arrangement of parts shown in the drawings or described in this specification as various changes therein are envisioned without departing from the spirit or the scope of the invention or of the following claims.

What I claim is:

1. A pallet-less container comprising, in combination:

a set of four identical drum shaped containers wherein each of said containers includes a flat top surface, a flat bottom surface and cylindrical side wall surfaces;

a base plate affixed to the bottom surface of each of said containers, the base plates being defined by an inverted frusto-conical configuration having a flat top surface and a flat bottom surface, and an inverted U-shaped channel extending diametrically through each of said base plates and opening out of the bottom surface thereof;

an elongated strap configured flat retainer adapted to be passed about the containers to retain the containers together in side-by-side parallel relationship, said strap having a first end and a second end, a single opening adjacent said first end extending through said strap, and a series of longitudinally spaced apart openings disposed in said second end of said strap providing selective adjustment; and a retainer spring having its opposite ends affixed to opposite ends of said retainer strap for retaining said retainer strap position about said containers.

* * * * *